US008100270B2

(12) United States Patent
Kuznetsov

(10) Patent No.: US 8,100,270 B2
(45) Date of Patent: Jan. 24, 2012

(54) SET OF PARTS FOR INFORMATION STAND

(76) Inventor: Valery Viktorovich Kuznetsov, Moscow (RU)

( * ) Notice: Subject to any disclaimer, the term of this patent is extended or adjusted under 35 U.S.C. 154(b) by 279 days.

(21) Appl. No.: 12/312,218

(22) PCT Filed: Apr. 13, 2007

(86) PCT No.: PCT/RU2007/000180

§ 371 (c)(1),
(2), (4) Date: Apr. 30, 2009

(87) PCT Pub. No.: WO2008/127140

PCT Pub. Date: Oct. 23, 2008

(65) Prior Publication Data

US 2010/0044532 A1 Feb. 25, 2010

(51) Int. Cl.
*A47F 7/00* (2006.01)

(52) U.S. Cl. ..... 211/13.1

(58) Field of Classification Search ..... 211/13.1, 211/126.1, 189, 10, 11, 126.2, 126.3; 220/23.2, 220/23.4, 23.6, 23.83; 312/198; 40/605, 40/800

See application file for complete search history.

(56) References Cited

U.S. PATENT DOCUMENTS

| | | | | |
|---|---|---|---|---|
| 4,074,810 | A * | 2/1978 | Juergens et al. | 211/11 |
| 4,429,796 | A * | 2/1984 | Sussman | 211/11 |
| 5,265,735 | A * | 11/1993 | Hassel et al. | 211/11 |
| 5,377,850 | A * | 1/1995 | Liaw | 211/163 |
| 6,092,672 | A * | 7/2000 | Harris et al. | 211/11 |
| 7,591,382 | B2 * | 9/2009 | Brock | 211/10 |
| 2005/0173355 | A1 * | 8/2005 | Stravitz | 211/11 |
| 2006/0244348 | A1 * | 11/2006 | Richied et al. | 312/108 |
| 2008/0011697 | A1 * | 1/2008 | Berg | 211/78 |

FOREIGN PATENT DOCUMENTS

| | | | |
|---|---|---|---|
| RU | 2160033 | C1 * | 12/2000 |
| RU | 2161899 | C1 * | 1/2001 |
| RU | 2171088 | C1 * | 7/2001 |
| RU | 2199932 | C1 * | 3/2003 |
| RU | 2219065 | C1 * | 12/2003 |
| WO | WO9824348 | A1 * | 6/1998 |

* cited by examiner

*Primary Examiner* — Jennifer E. Novosad

(74) *Attorney, Agent, or Firm* — The Nath Law Group; Jerald L. Meyer; Stanley N. Protigal

(57) ABSTRACT

The set parts of the information stand has pieces like solid box-shaped assembly modules, among them at least one square module (1), at least one right-angled module (2), at least one isosceles triangular module (3), at least one sectored convex module (4), and at least one sectored concave module (5), meanwhile sectored modules (4, 5) being right-angled with the angular stretch making up one fourth of the circumference. Each module has flat bottom (7) and at least two mutually perpendicular rectilinear walls (8) to mate adjacent modules. Sectored convex module (4) has arcuate wall (9), while sectored concave module (5) has arcuate wall (10). Polygonal module (6) has rectilinear walls (8) arranged along the legs of the right-angled triangle, while wall (11) arranges along the conditional hypotenuse of the triangle and it being a broken star-shaped line. Walls (8, 9, 10, 11) have the height at least 0.075 of the length of walls (8) of module 1. Module 2 has a holder made like overlay frame (12) of flat information carrier (13) of the A4 format, while module (14) has a holder like container (15) of the 3D information carrier. The length of walls (8) of all modules (1-6, 14) are made multiple of the least one of these lengths.

12 Claims, 12 Drawing Sheets

B-B

SET OF PARTS FOR INFORMATION STAND

Figure 1:
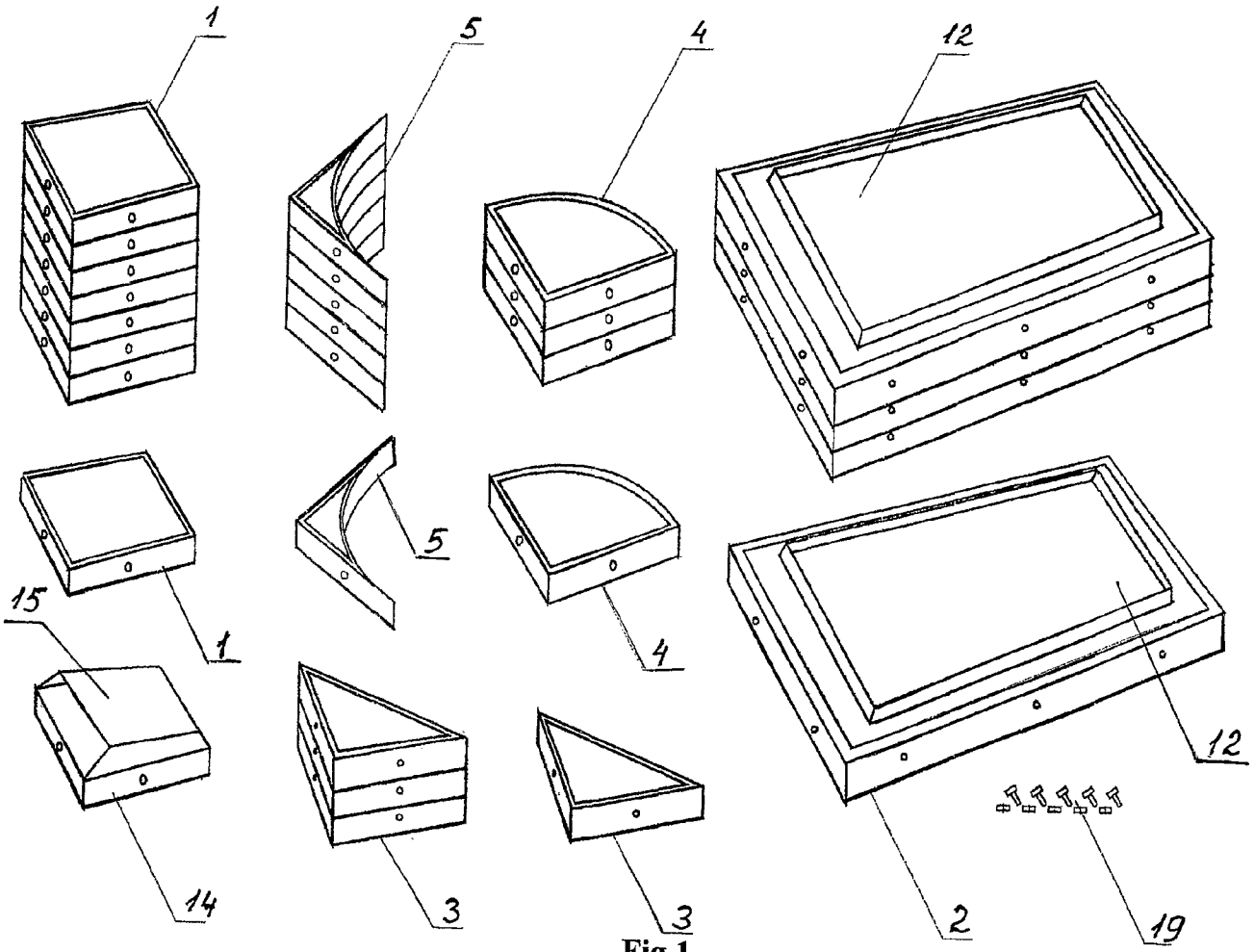

This is a National Phase Application filed under 35 U.S.C. 371 as a national stage of PCT/RU2007/000180, with the filing date of Apr. 13, 2007, the entire content of which is hereby incorporated by reference in its entirety.

FIELD OF THE INVENTION

The invention relates to devices for visual information and presentation of various goods, scientific and technological achievements, preservation of information materials and goods, and it can be useful in various spheres, such as promotion, information circulation, education, styling decoration, etc.

PRIOR ART

There is a unitized information stand and a set of parts for it comprising a frame suspended or fixed on tripod legs, information holders or/and secured by fasteners, the stand consists of standard holders of multiple standard sizes that are interlinked by fasteners forming a cellular structure and carrying a peripheral shelf-like flange, the holders forming a cellular structure shaped right-angled or as a projecting board, each holder comprising a right-angled body with the length and width exceeding those of the sheets sizes A4, A3, A2, A1, A0 by 20-70 mm towards the side of the flange equal to 20-100 mm, having a flat, face surface with a profiled groove, stiffness ribs on the inner side, at least one hollow recess with a shaped mounting hole on the bottom with a decorative plug, the information holder has a flat, transparent plastic screen with an oval notch, an opening, a gap between the screen and the holder's face surface where the information substrate 1-50 mm is arranged, with round pins over the periphery welded into the rivets when the information holder is secured to the body (RU No. 2161899, 2001).

The drawbacks of these set and stand are their limited functionality of transformation of the geometric configuration, limited number and flexibility of the information stands, insufficient mobility for fast movement, high required standards of qualification of the maintenance personnel, intricate and time-consuming assembly and disassembly of the framework and holders, making it impossible to achieve expressive associations with objects within the stand shell.

There is a collapsible cellular information stand and a set of parts for the stand that comprises a frame suspended or fixed on tripod legs, consisting of standard information holders of multiple standard sizes, interlinked by fasteners forming a cellular structure and having a peripheral shelf-like flange, the information holders being designed cellular right-angled shaped or with a projecting board, each information holder made from the plastic consists of a right-angled body with the ratio between its width and height 1:1, or 1:2, or 2:3, and exceeding the width and length of the sheets sizes A4, A3, A2, A1 by 20 mm sideward, a peripheral shelf-shaped flange equal to 10 mm and more with fixing platforms having each at least one assembly hole, a flat or cylindrical face surface with a profiled grove, stiffness ribs on the inner side, at least one hollow opening with a mounting round or shaped hole on the bottom with a decorative plug covering the hollow opening, the information holder with an insertion slot and a visor holding the information leaflet in the holder body. This stand permits to assemble a variety of projecting units and rearrange the information, to vary color combinations of components making the stand geometrically dynamic, to add panning, shrinking, and other effects (RU #2171088, 2001, the prototype)

The drawbacks of these set and stand are limited functionality when transforming the geometrical configuration, a limited number and variability of information stand sets, insufficient mobility for fast movement, high standards set to the qualifications of the maintenance personnel, intricate and time-consuming assembly and disassembly due to the need to utilize a frame or a framework to fix holders (modules), poor standardization of parts that disable achievement of artistic expression, bright object presentation, for example, like animals, fairytale characters, objects of human creativity.

SUMMARY OF THE INVENTION

The described technical task is to design an effective set of standard holders for a cellular information stand and to expand the range of sets of standard holders for the cellular information stand.

The technical result that ensures solution to the formulated problem consists of expansion of the functionality of transformation of the geometrical configuration in order to boost the number and variety of the information stands, to ensure mobility for fast movement, to increase the level of standardization of the stand parts, to mitigate the requirements to the qualification of the maintenance personnel, to save the time of transformation and to facilitate the assembly and disassembly.

The concept of the disclosure is that the set of parts for the information stand comprises box-shaped solid assembly modules each with a flat bottom and at least two mutually perpendicular walls interfacing the adjacent modules, at least one holder of the type of an overlay frame for a flat information carrier and at least one holder of the type of a container for a 3D information carrier, it contains the modules of the type of at least three geometrical figures from the group of square, right-angled, triangular and sectored ones, the modules have right-angled walls at least 0.075 of the length of the smallest right-angled walls of the modules, the joint between the inner sides of the right-angled walls and the bottom of each module is provided with a peripheral shoulder, the relevant outer periphery has a right-angled groove equidistant from the said shoulder, the rectangular walls of the modules are provided with holes for fasteners that are drilled at the same height from the bottom and equidistant from the ribs of the modules designed to insert one into another producing a billboard with a spatial cellular structure.

The set comprises preferably at least one square module, at least one right-angled module, at least one triangular module, at least one sectored convex module and at least one sectored concave module, the sectored modules having the angular size of one fourth of the circumference, and it can contain one polygonal module with right-angled walls arranged along the legs of the tripod, while the wall arranged along the hypotenuse is made as a broken star-shaped line.

The flat bottoms and walls of the modules are similarly thick, the lengths of the right-angled walls of the modules are multiple of the shortest length, the walls of the modules being provided with equally spaced holes and equidistant from the module rib multiple to a segment of the length that equals to a half of the least long right-angled side of the modules, the joints of the right-angled walls of each module are provided with stiffness ribs, the overlay frame of the flat information carrier is provided with a transparent screen, the container of the 3D information carrier is made integral with the module, or the container of the 3D information carrier is shaped like a pocket, a basket or a framed wire-type shelf. The modules are made from the die-pressed plastic coated with pigmented superconcentrates applied in the process of casting, the fasteners are bolts, screws and nuts, the set being preferably provided with a suitcase-type box having a carrying handle.

PREFERRED EMBODIMENT DETAILED DESCRIPTION OF THE INVENTION

The drawings in

Figure 2:
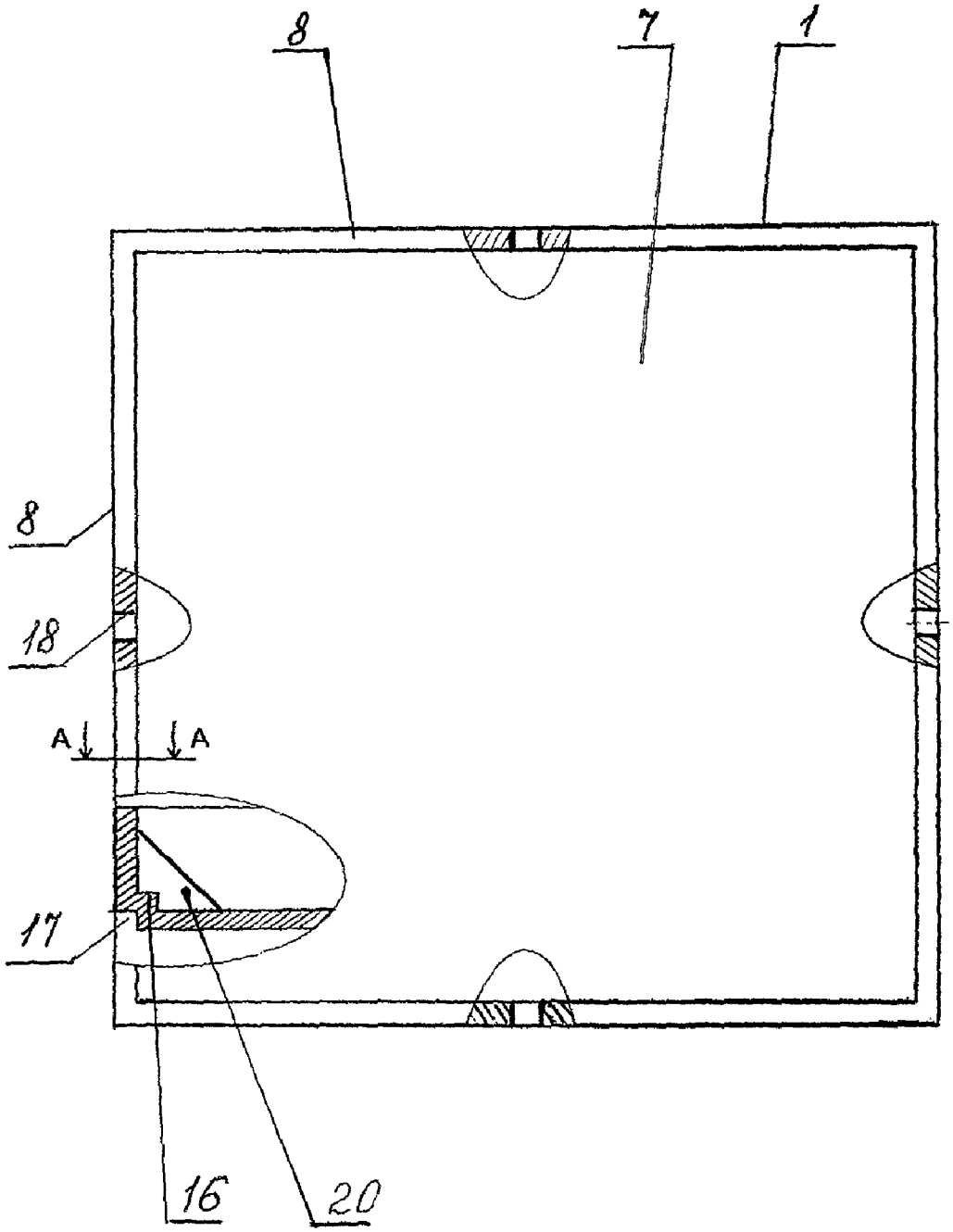
Figure 3:
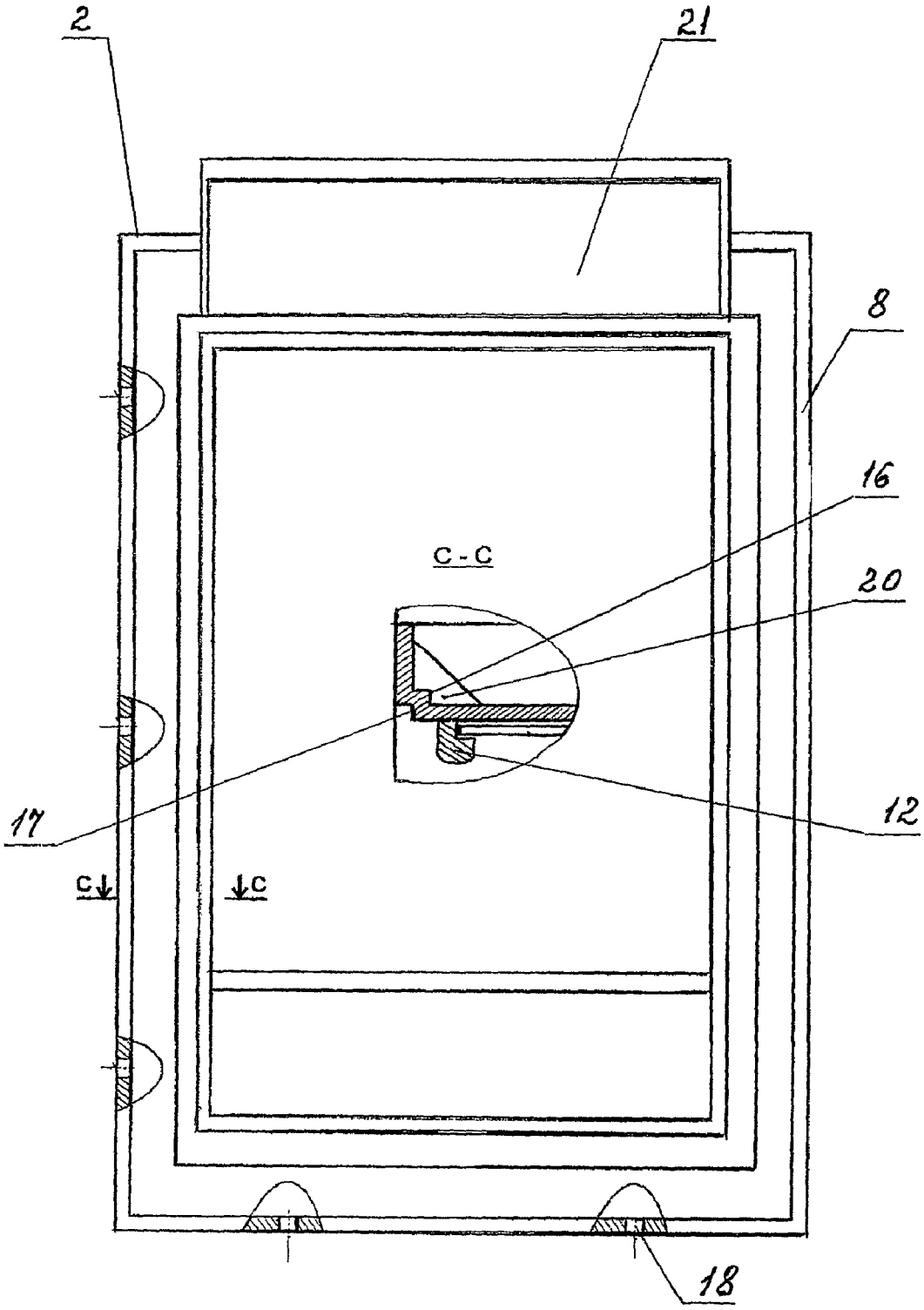
Figure 4:
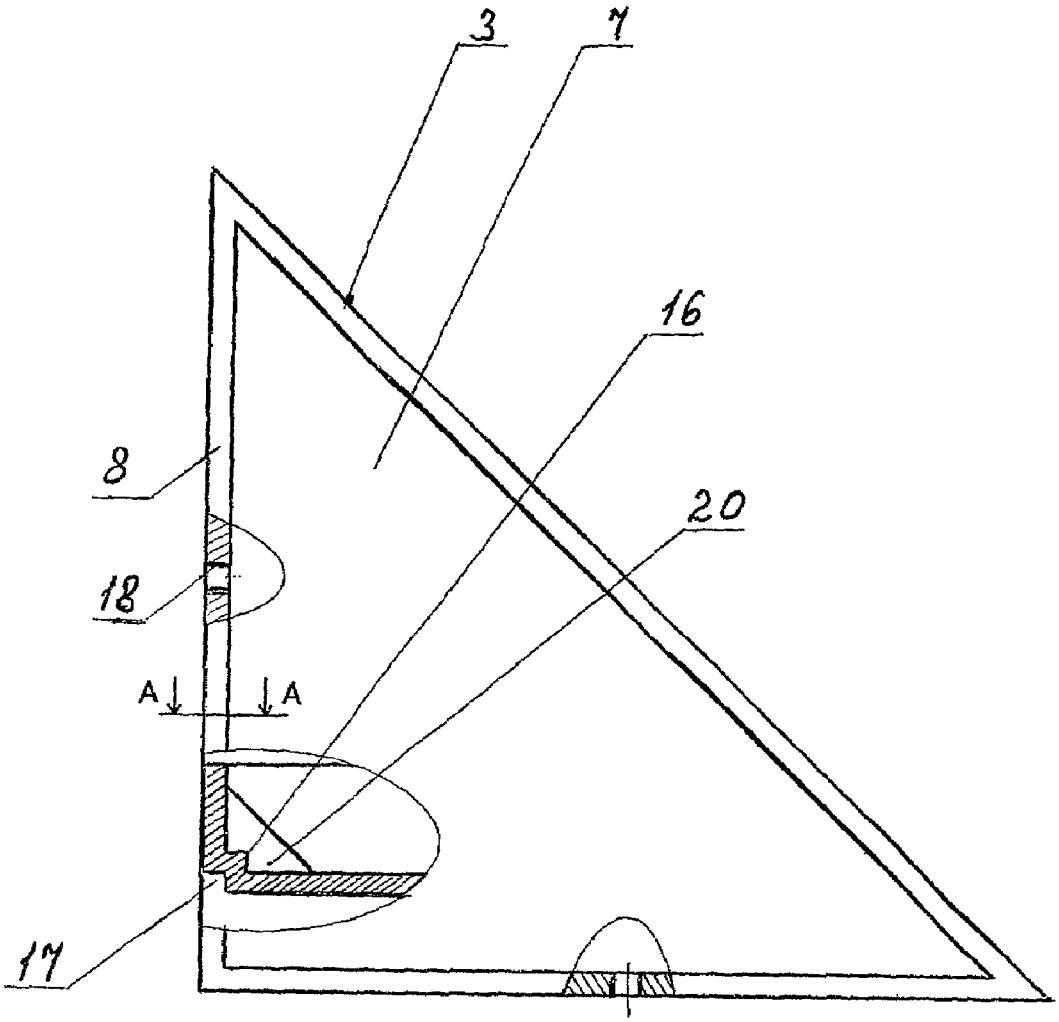
Figure 5:
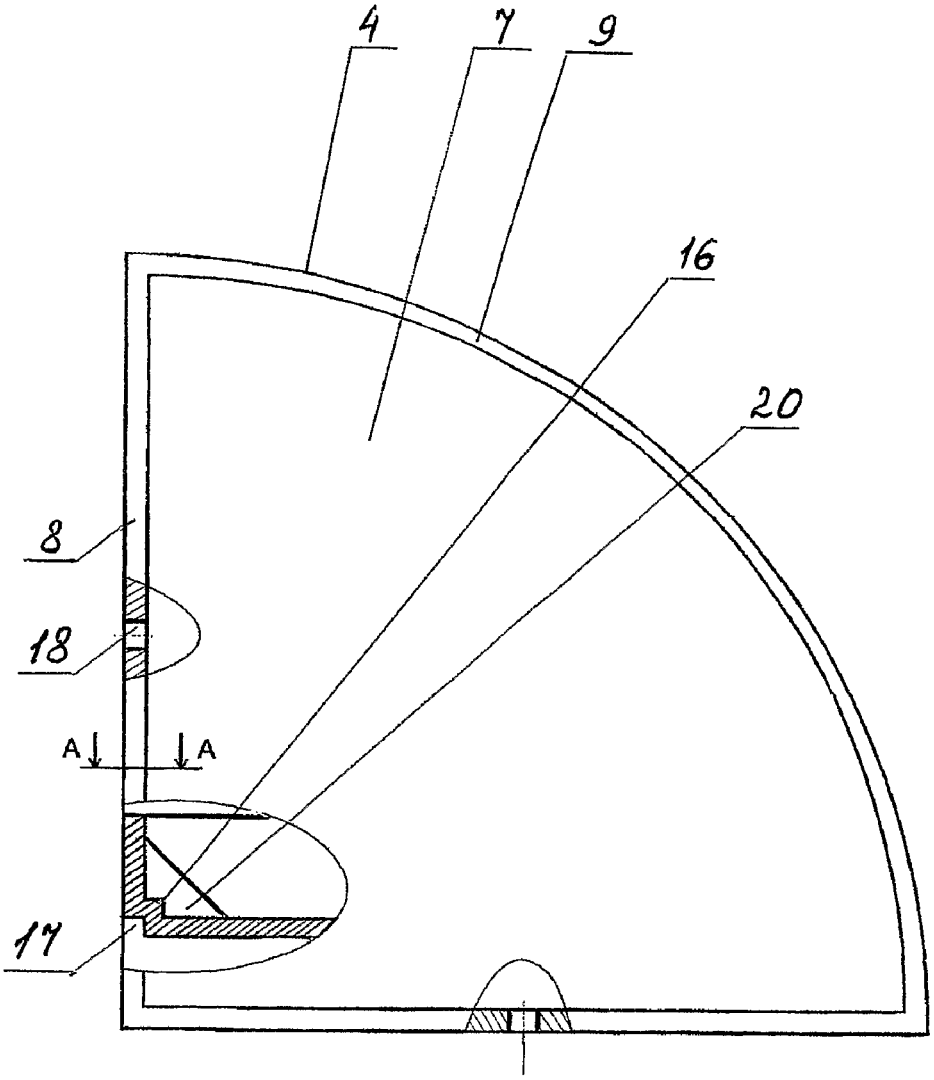
Figure 6:
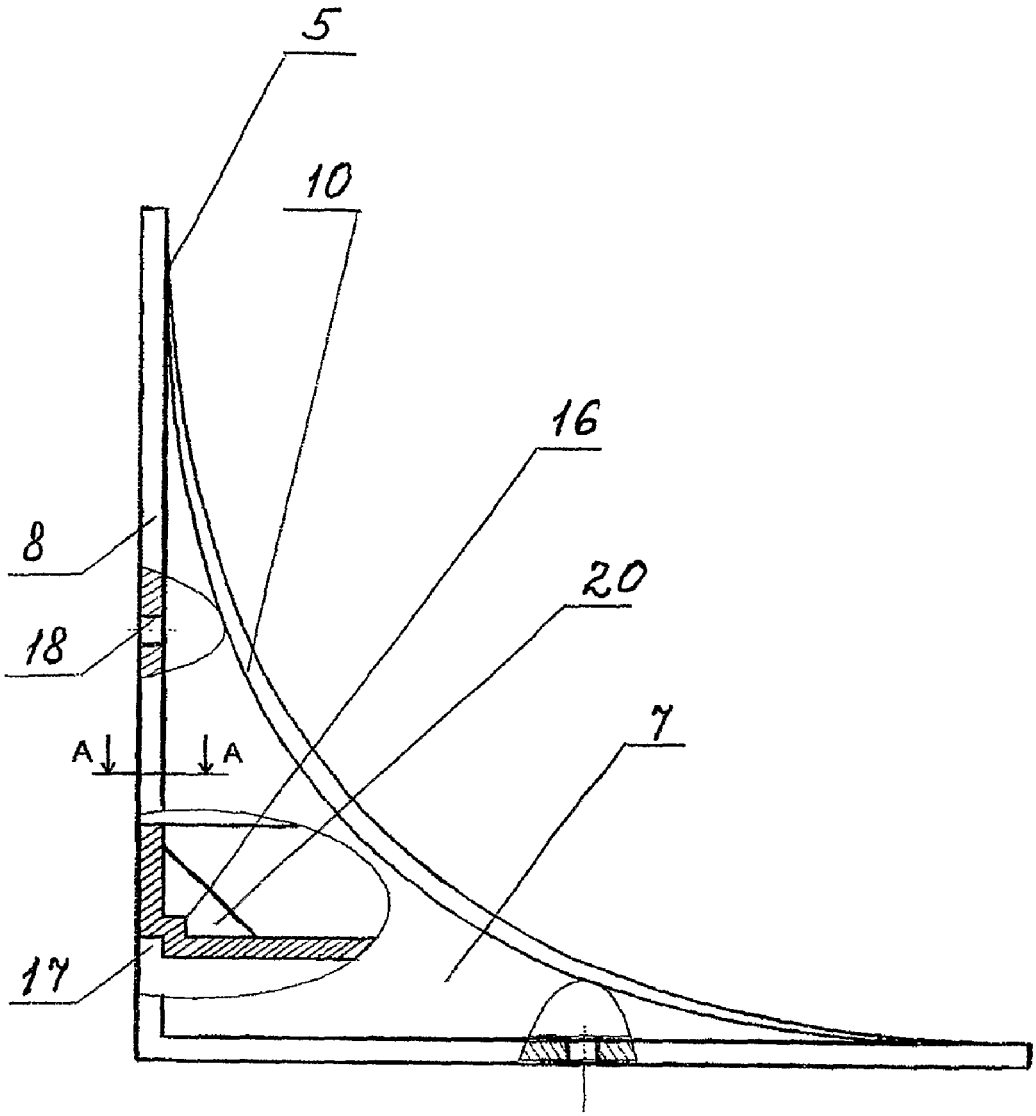
Figure 7:
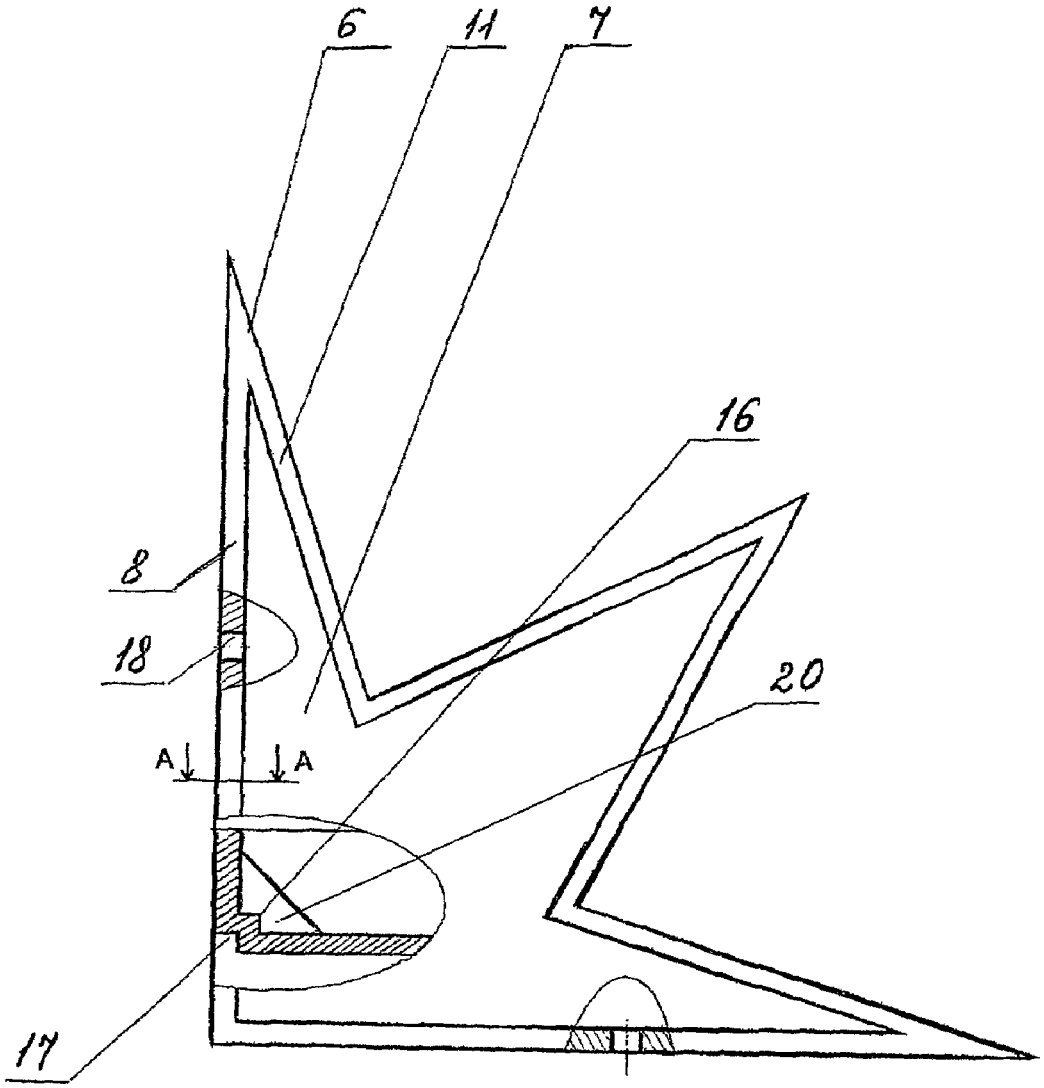
Figure 8:
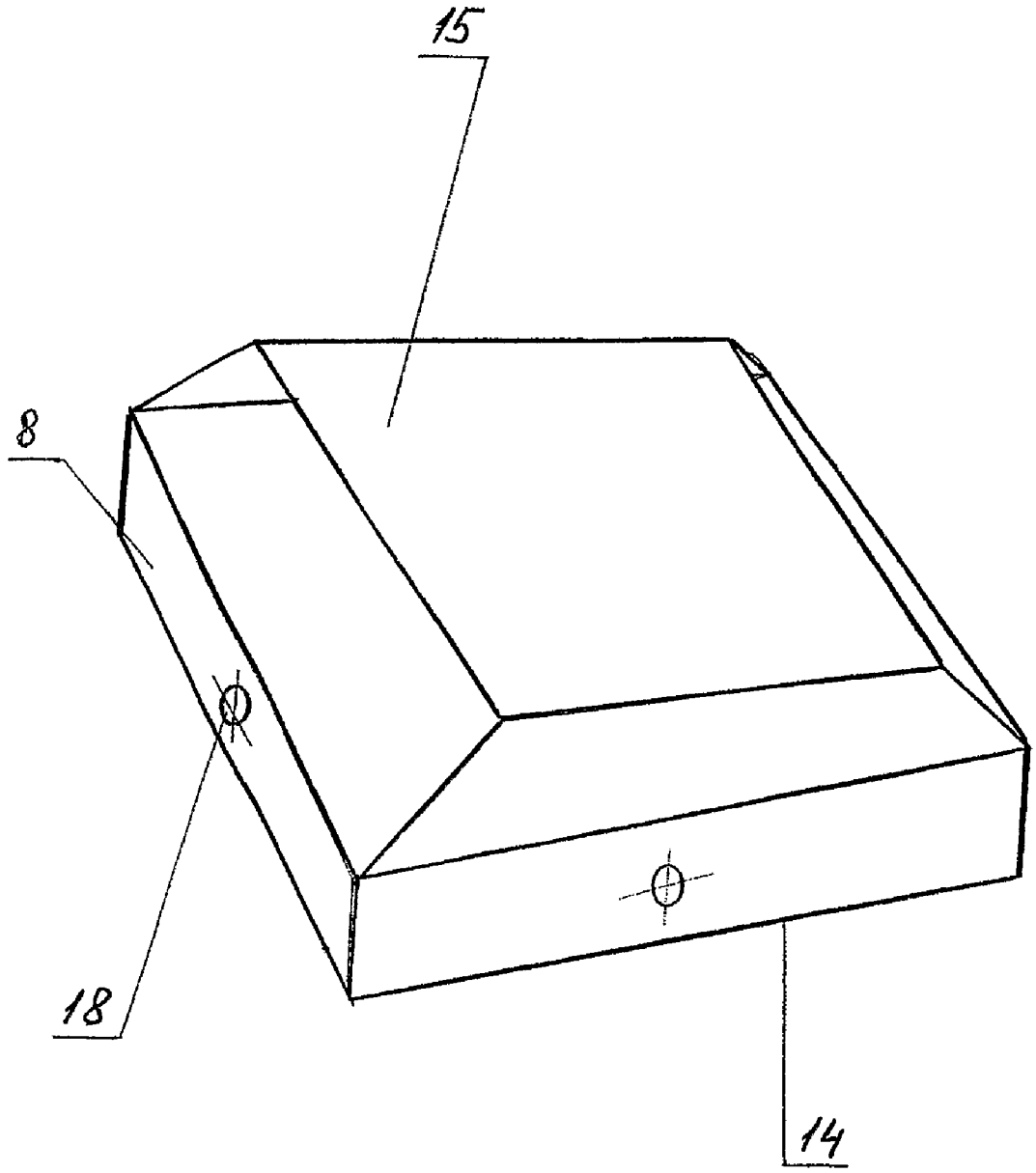
Figure 9:
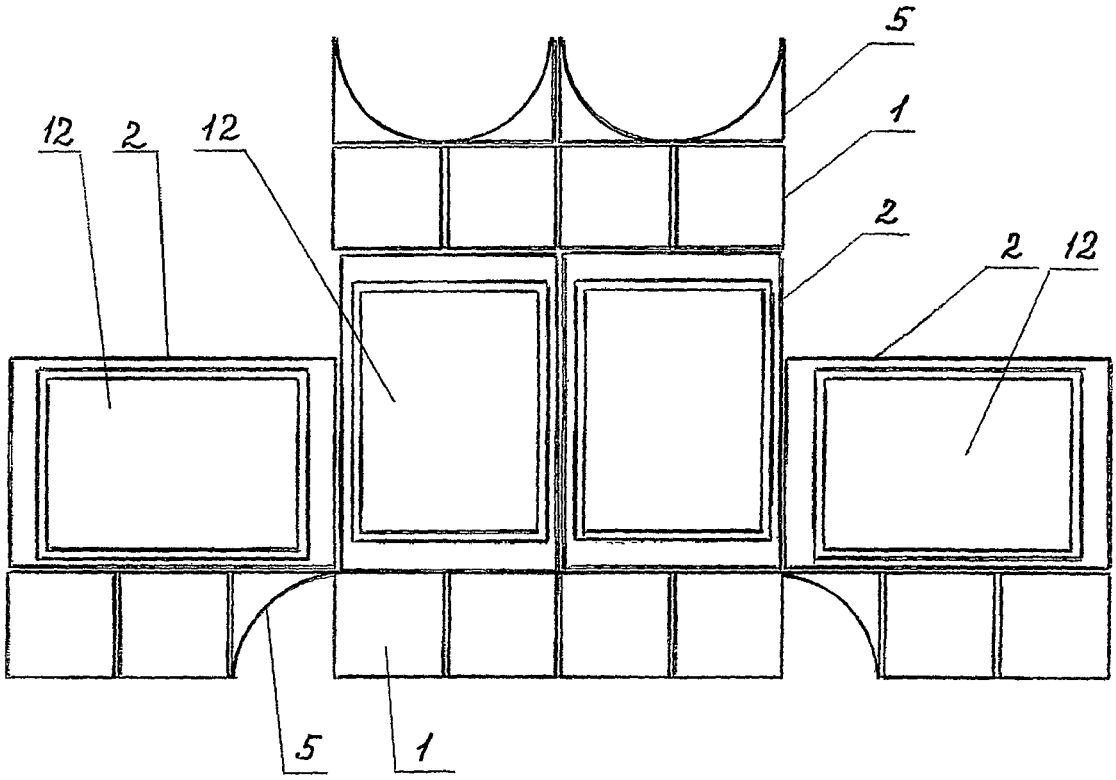
Figure 10:
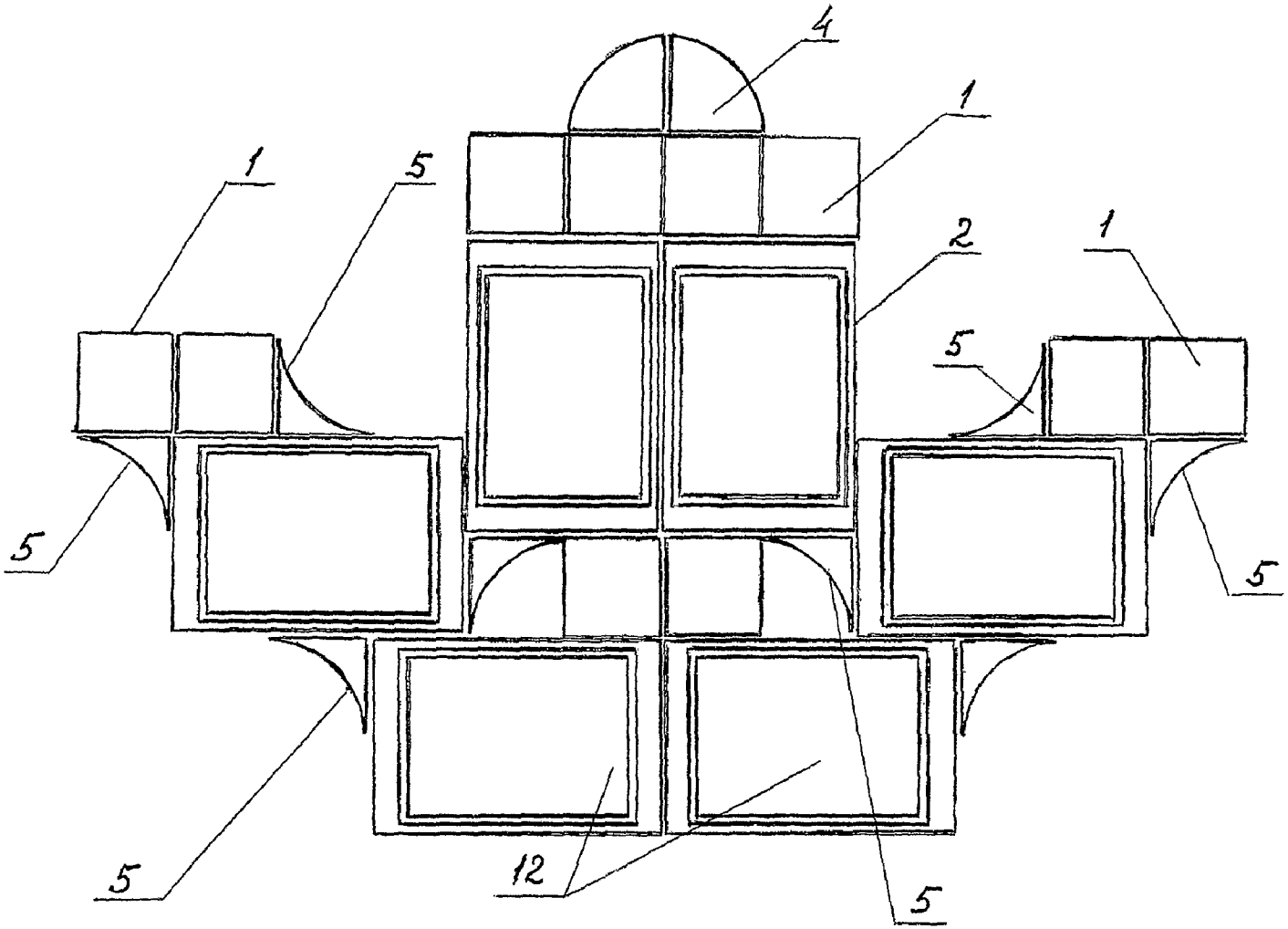
Figure 11:
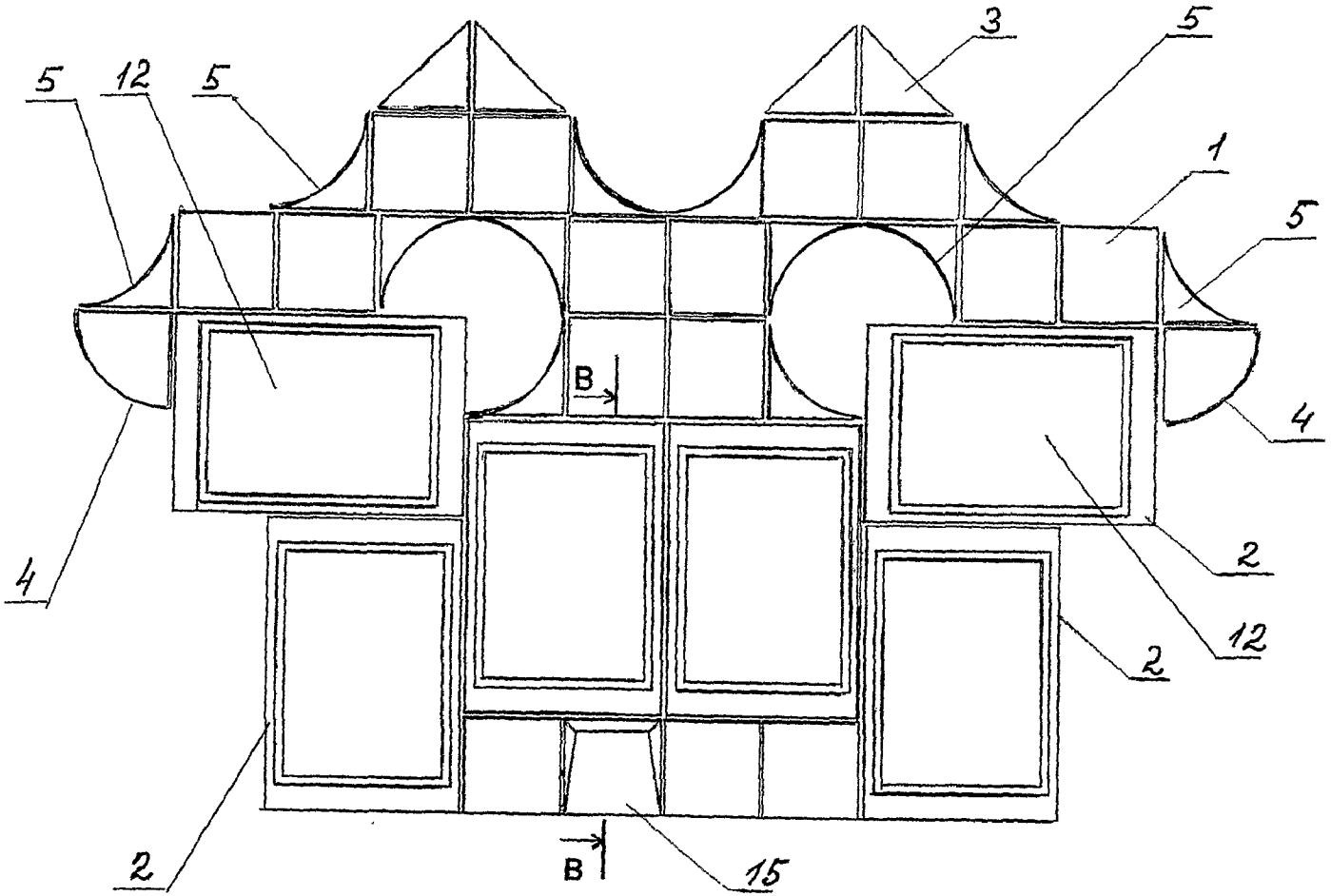
Figure 12:
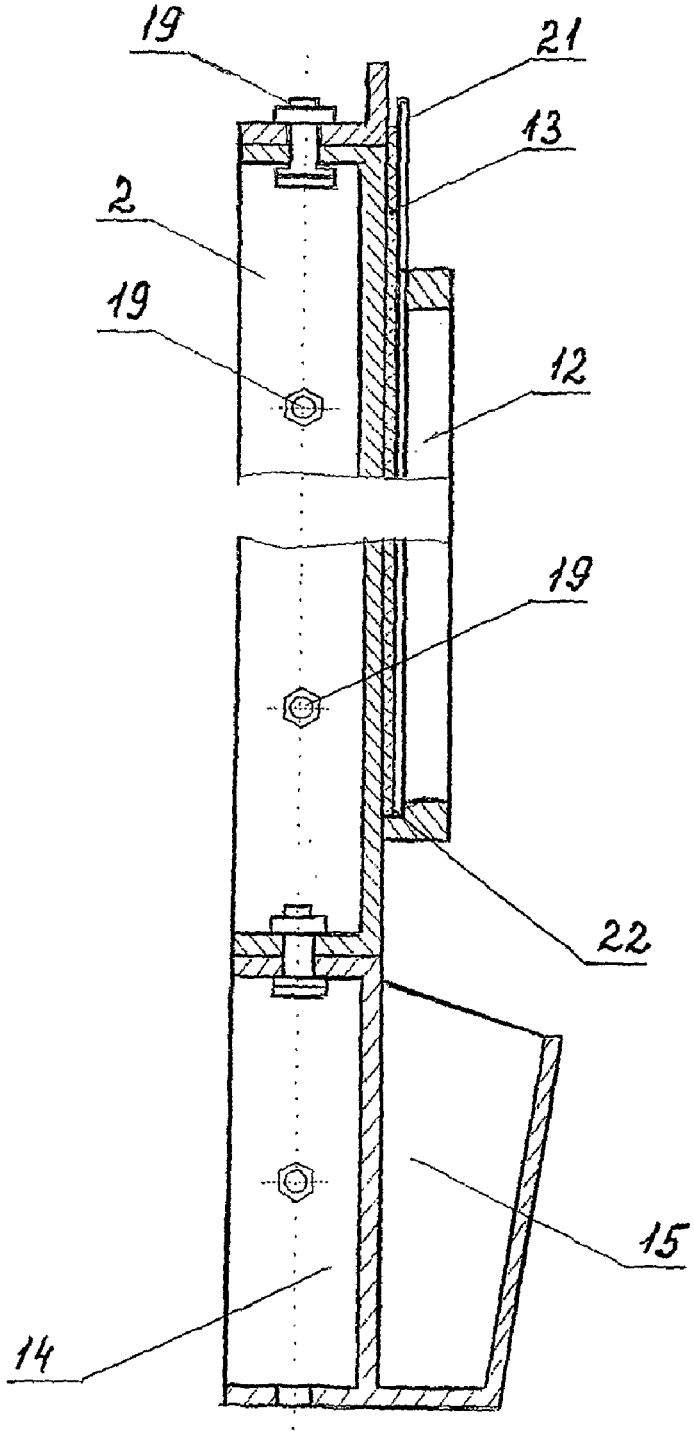

FIG. 1 show the set of parts for the information stand with stop-mounted modules, FIG. 2—the square module and its cross section, FIG. 3—the right-angled module with the holder such as an overlay frame, FIG. 4—the triangular module and its cross section, FIG. 5—the sectored convex module and its cross section, FIG. 6—the sectored concave module and its cross section, FIG. 7—the polygonal module, FIG. 8—the module with a container-like holder, FIGS. 9, 10, 11—alternatives of assembly of the stand, FIG. 12—a cross section of the stand in FIG. 11.

The set of parts for the information stand comprises box-shaped solid assembly modules, among them at least one square module 1, at least one right-angled module 2, at least one isosceles triangular module 3, at least one sectored module 4, and at least one sectored concave module 5, sectored modules 4, 5 being right-angled with the angular size equal to one fourth of the circumference.

In addition, it may include at least one polygonal module 6.

Each module has flat bottom 7 and at least two mutually perpendicular rectilinear walls 8 for interfacing the adjacent modules. Sectored convex module 4 has convex arcuate wall 9, meanwhile sectored concave module 5 has concave arcuate wall 10. Polygonal module 6 has rectilinear walls 8 arranged along the legs of the right-angled triangle, while wall 11 is arranged along the conditional hypotenuse of the triangle in a broken star-shaped line. Walls 8, 9, 10, 11 have the height equal to 10-25 mm, i.e. at least 0.075 of the length of wall 8 of module 1 that is equal to 110-130 mm.

Module 2 has a holder like overlay frame 12 for flat information carrier 13 (an information leaflet) of the A4 format, while module 14 has a holder like container 15 for a 3D information carrier (not shown) with the opening facing upwards. The length of rectilinear walls 8 of all modules 1-6, 14 are made multiple to the least of these lengths, i.e. to the length equal to 110-130 mm of walls 8 of module 1. The inner sides of the perimeter of rectilinear walls 8 and bottom 7 of each module 1-6, 14 has right-angled shoulder 16, while the corresponding outer perimeter has rectangular groove (recess) 17 with the cross section 2.5.times.2.5 mm equidistant from (parallel to) shoulder 16. Rectilinear walls 8 of modules 1-6, 14 have holes 18 with the diameter 3-5 mm to fit fasteners 19. Holes 18 arrange at the same height from bottom 7 of each module 1-6, 14 in the center of each segment equal to the least length of rectilinear walls 8 of modules 1-6, 14. For instance, holes 18 are spaced mutually and from the rib of the module at a distance multiple of the segment having length one-half of the least length of rectilinear sides 8 of modules 1-6, 14.

Modules 1-6, 14 are made to insert modules 1-6, 14 one into another producing a billboard of a spatial cellular design.

Flat bottom 7 and walls 8 of modules 1-6, 14 are similarly thick.

Joints of walls 8 of the modules are provided with stiffness ribs 20.

Overlay frame 12 of the flat information carrier is covered with protective transparent plastic screen 21.

Container 15 of 3D information carrier can be made integral with module 14.

Container 15 of the 3D information carrier can be shaped as a pocket, a basket, or a wire-type framed shelf (not shown).

Modules 1-6, 14 are a pressure die cast plastic coated in casting with indelible pigmented superconcentrates. Fasteners 19 are bolts, screws, and nuts. Frame 12 has insertion slot 22.

The set of parts for the information stand is used in the following manner.

When disassembled the set of parts of the information stand is a pile of plastic parts kept in a cardboard box (not shown) that is made like a suitcase with a handle for transportation. Recesses (grooves) 17 accommodate 30-50 modules 1-6, 14 in piles during storage and transportation.

To assemble the information stand the user joins the set of parts of modules 1-6, 14 with fasteners 19, i.e. bolts, screws, nuts, using tools like a screwdriver and a spanner following the recommended or developed independently configuration diagram of the stand. Walls 8 joined with fasteners 19 have the contact area determined by their height and length and they form a cellular system of stiffness ribs of the stand that enables to use an additional frame or a framework. The stand is fixed due to this special shape of securing to interfaced walls 8 and it is possible to place it on console bearing feet on the floor. The face surfaces of all modules 1-6, 14 of the assembled stand produce a single face surface of the stand.

The set of parts provides broad flexibility of re-arrangement and re-orientation of information modules 1-6,14, it enables to devise new general configurations, new images of the relevant presented information so that the exposition achieves its purpose, suits the age, interest and aspirations of users.

Alternative configurations of the stand by combining different numbers of all or at least three modules from group 1-6, 14, permit to achieve definite tasks.

To use the flexible stand, information leaflets 13 are fixed in frames 12, objects, or 3D information carriers, are placed into containers 15 that can be on the shelf, in the basket, or three-dimensional pockets. All information carriers are quick replaceable, i.e. the stand is refreshable.

As a rule, there are two types of information materials on paper sheets: usual traditional illustrative text on standard or non-standard paper sheets, or special in the form of laminar paper object models, cards with cutout projecting elements. Information leaflets 13 are developed in color spots and with subjects explaining or emphasizing a relevant object on the stand. Information leaflet 13 with protective transparent screen 21 is inserted into frame 12 through insertion slot 22. Information module 2 can be positioned horizontally or vertically.

The 3D information carriers (objects) are toys, office implements, books, albums, electrical appliances, compact discs, etc., methodological and promotion materials like booklets, leaflets, that can be displayed on shelves, in baskets, three-dimensional pockets.

A particular alternative of using the stand is a training illustrated task of search for a new image configuration to teach adults the skills of creativity without any initial securing of the elements.

Visitors to an exposition or a similar public event have an opportunity to view and study directly the information displayed on the information carrier stand.

So, a set of parts of the flexible information stand is developed with the minimal number of stand pieces that enables to quickly change, re-orient information carriers between vertical and horizontal positions, to adapt the 3D information content on the stand up to 2-3 m.sup.2 in area without any auxiliary frames, boards, and that can be assembled with standard common fasteners and can be quickly packed into a cardboard box up to 0.5 m sidewise for transportation by post, mobility, use, disassembly, multiple transformation of the stand to obtain the configurations resembling objects of the fauna, flora, man-made objects, artistic images, expanding the sphere of application of the standard information stand to turn it into a multifunctional object displaying device, including opportunities for development of creativity of children and adults. The contour arrangement of the fasteners simplifies the securing of the modules and other accessories making it easy to assemble a three-dimensional, self-sufficiently rigid design, to change the flexible stand many times starting with a limited number of components, i.e. to achieve a variety of artistically designed images. The surfaces of the components can be decorated.

The set uses the modules of the flat box mutually dependent shape with stiffness ribs, the fixing holes in the lateral shelf faces of all the modules lie in one plane. The dimensions of all the components are tied up to the dimensions of the principal module with the minimal length of rectilinear sides.

A high uniformity is achieved by a single design, equality, multiplicity of dimensions, proportions of the components, and the system of arrangement of fixing points.

The stand assembled with the set provokes image associations, becomes an evolving commodity for pre-school, school institutions as a visual aid, a piece of interior decoration, a household play corner, a toy maccino, a personal creative tools for educators, specialists, public leaders and it is a new implement to develop ingenuity of adults.

The service life of the flexible stand is unlimited.

INDUSTRIAL APPLICATIONS

The present invention is embodied with multipurpose equipment extensively employed by the industry.

The invention claimed is:

1. A set of parts for an information stand comprising:

a plurality of solid box-shaped assembly modules each having a flat bottom and at least two mutually perpendicular walls for interfacing with adjacent modules, at least one holder configured as an overlay frame for a flat information carrier, and at least one holder configured as a container of a 3D information carrier, said container of a 3D information carrier containing modules of at least three geometrical figures selected from the group consisting of square, right-angled, triangular, and sectored, the modules configured with a length of each rectilinear wall of the modules provided as a multiple by shortest length of a joint over an inner side of the rectilinear walls, the bottom of each module having a peripheral right-angled projection, and the outer perimeter having a rectangular groove equidistant from the said projection, the modules having at least one reinforcing rib, wherein the rectilinear walls of the modules have holes for fasteners arranged at the same height from the bottom and at the same distance from the ribs of the modules, the attachment of the modules with the fasteners using the holes making up a billboard of a three-dimensional cellular design.

2. The set according to claim 1, characterized in that the set contains at least one square module, at least one right-angled module, at least one triangular module, at least one sectored convex module, and at least one sectored concave module, the sectored modules having a concave stretch making up a circumference of one fourth arc.

3. The set according to claim 1, characterized in that the set contains at least one polygonal module with the rectilinear walls arranged along legs of a tripod, while the wall along a hypotenuse of a conditional triangle formed by two of the rectilinear walls to form a broken star-shaped line.

4. The set according to claim 1, characterized in that the flat bottom and the walls of the modules are equally thick.

5. The set according to claim 1, characterized in that the walls of the modules have holes mutually equidistant and equally spaced from the ribs of the modules at a distance multiple of the segment with the length equal to half of the shortest rectilinear sides of the modules.

6. The set according to claim 1, characterized in that joints of the rectilinear walls of each module are provided with stiffness ribs.

7. The set according to claim 1, characterized in that that the overlay frame of the flat information carrier is covered with a transparent screen.

8. The set according to claim 1, characterized in that the container of the 3D information carrier is made integral with the module.

9. The set according to claim 1, characterized in that the container of the 3D information carrier is shaped as a pocket, a basket, or a wire-type frame shelf.

10. The set according to claim 1, characterized in that the modules are plastic pressure die cast and coated with pigmented superconcentrates during casting.

11. The set according to claim 1, characterized in that the fasteners are bolts, screws, and nuts.

12. The set according to claim 1, further comprising a box configured as a suitcase with a plastic handle for transportation.

* * * * *